United States Patent [19]

French et al.

[11] Patent Number: 4,888,901

[45] Date of Patent: Dec. 26, 1989

[54] FIREARM

[75] Inventors: Kendrick L. French, Lebanon, Me.; Mark C. Laney, New Market, N.H.

[73] Assignee: K. W. Thompson Tool Co., Inc., Rochester, N.H.

[21] Appl. No.: 342,998

[22] Filed: Apr. 25, 1989

[51] Int. Cl.[4] ..... F41C 21/00

[52] U.S. Cl. ..... 42/51; 42/83

[58] Field of Search ..... 42/51, 83

[56] References Cited

U.S. PATENT DOCUMENTS

| | | | |
|---|---|---|---|
| 158,221 | 12/1874 | Smith | 42/51 |
| 3,757,447 | 9/1973 | Rowe | 42/51 |
| 4,700,499 | 10/1987 | Knight | 42/51 |
| 4,715,139 | 12/1987 | Rodney, Jr. | 42/51 |

*Primary Examiner*—Charles T. Jordan

*Attorney, Agent, or Firm*—Norman S. Blodgett; Gerry A. Blodgett

[57] ABSTRACT

Muzzle-loading firearm which ignites the powder by means of a percussion cap located on a nipple coaxially of the bore, a venting passage directing gas laterally of the nipple.

4 Claims, 2 Drawing Sheets

FIREARM

BACKGROUND OF THE INVENTION

Most of the traditional muzzle-loading guns were ignited by a flint lock or by a percussion cap; in both cases, the ignition device was maintained on the side of the gun and the ignition spark was fired into a nipple passage that was directed sideways. When the gun was fired, the backfire gas was projected out of the nipple passage and laterally of the gun. Recently, however, it has been suggested that a muzzle-loading firearm could be fired advantageously by a percussion cap mounted on a nipple located at the rear end of the barrel and coaxial of the bore. This concept was shown and described in the patent application of French et al Ser. No. 254,953 filed Oct. 7, 1988. One of the problems with this axial ignition arrangement is that the backfire is directed rearwardly around the hammers. These and other difficulties experienced with the prior art devices have been obviated in a novel manner by the present invention.

It is therefore, an outstanding object of the invention to provide a firearm of the muzzle-loading, percussion cap ignited type, in which ignition takes place coaxially of the barrel, but backfire is directed laterally.

Another object of this invention is the provision of a muzzle-loading firearm having symmetrical firing.

A further object of the present invention is the provision of the firearm ignited by a percussion cap and wherein backfire ejection is symmetrical.

With these and other objects in view, as will be apparent to those skilled in the art, the invention resides in the combination of parts set forth in the specification and covered by the claims appended hereto.

SUMMARY OF THE INVENTION

In general, the invention consists of a firearm having a receiver and a barrel mounted in the receiver and having a bore to receive a projectile. A chamber element is mounted on the rear end of the barrel and has a generally cylindrical chamber facing down the barrel coaxially of the bore. A nipple is mounted at the rear end of the chamber element and has a primer bore which is coaxial at the bore and the chamber A venting passage extends through the chamber element and the receiver to the exterior from the axis of the bore to both exterior sides of the receiver.

More specifically, a small bore extends from the chamber into the venting passage and a small bore extends from the primer bore into the venting passage, the cross-sectional area of the venting passage being substantially greater than that of either of the said small bores.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

It is obvious that minor changes may be made in the form and construction of the invention without departing from the material spirit thereof. It is not, however, desired to confine the invention to the exact form herein shown and described, but it is desired to include all such as properly come within the scope claimed.

Figure 1:
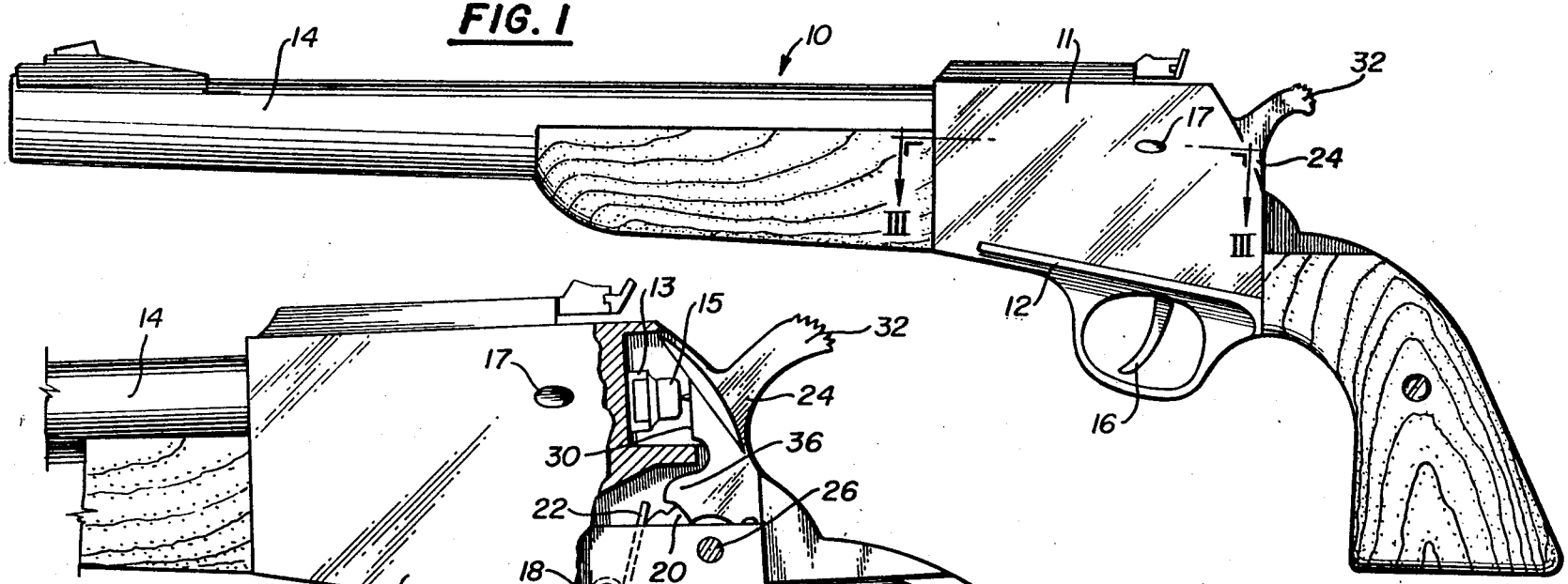
FIG. 1 is a side elevational view of a firearm incorporating the principles of the present invention.
Figure 2:
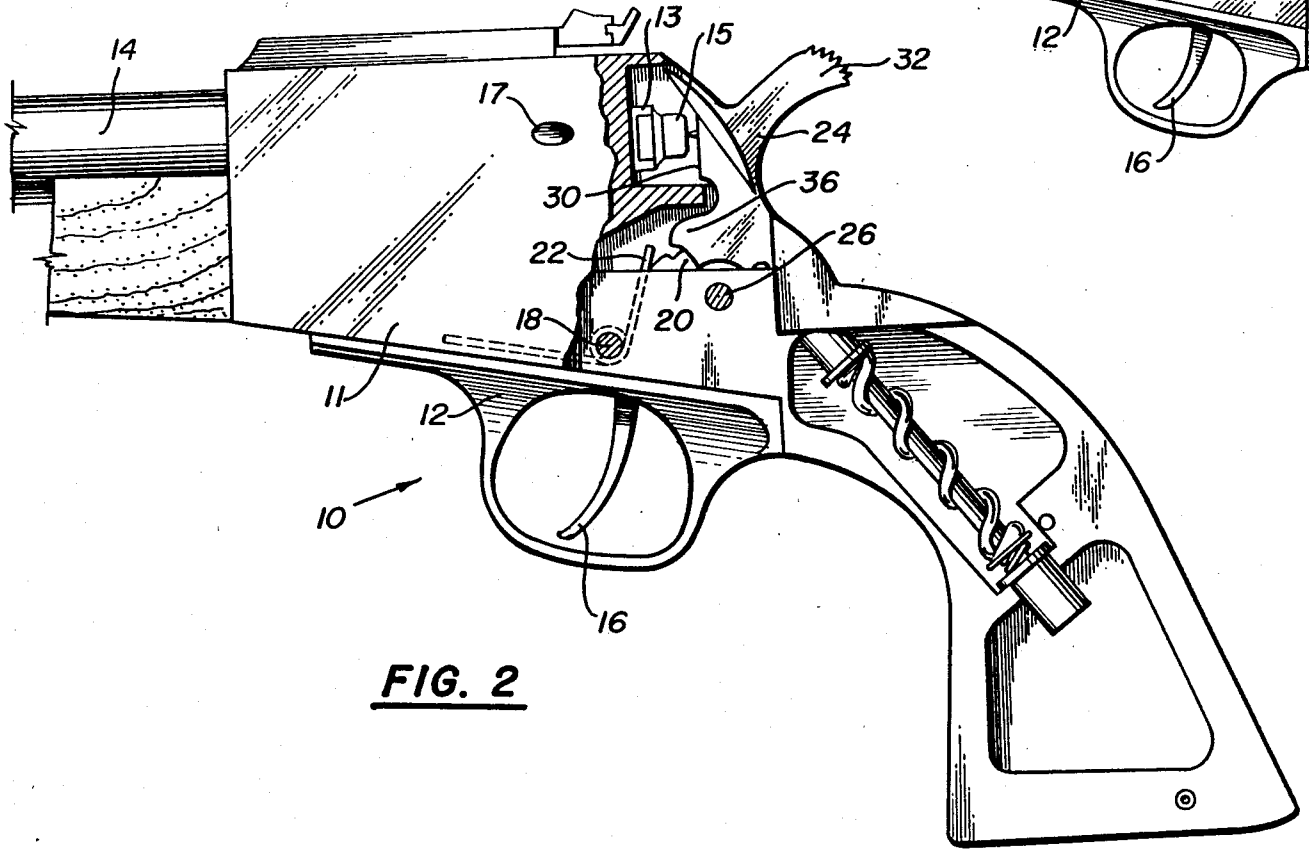
FIG. 2 is a side elevational view of the firearm, somewhat enlarged and with portions broken away.

Referring first to FIGS. 1 and 2 there is shown a firearm embodying the principles of the present invention and generally indicated by the reference numeral 10. The firearm 10 is by way of example a muzzle-loading, black-powder pistol having a receiver 11, a frame 12, a barrel 14, and a nipple 13 which carries a percussion cap 15 which is mounted behind the firing chamber of the firearm. The trigger 16 is pivotally connected to the frame 12 by means of a pivot pin 18 and biased to the forward position shown in FIG. 2 by a spring 22. A hammer 24 is pivotally connected to frame 12 by means of a pivot pin 26. A venting passage 17 exists on the opposite sides of the receiver.

A hammer block 20 is integral with the trigger 16 and extends upwardly from the pivot 18. The hammer block 20 normally occupies a rearward position when the trigger 16 is in its forward position The hammer block 20 has a rearwardly-facing surface which has a rearwardly facing notch. The hammer 24 has a forwardly facing striking surface 30 which is in line with the percussion cap 15 and a thumb grip 32 for moving the hammer 24 about the pivot pin 26 from an intermediate position to a rearward, cocked position. When the hammer 24 is in its intermediate position, it is spaced from the percussion cap 15.

Figure 3:
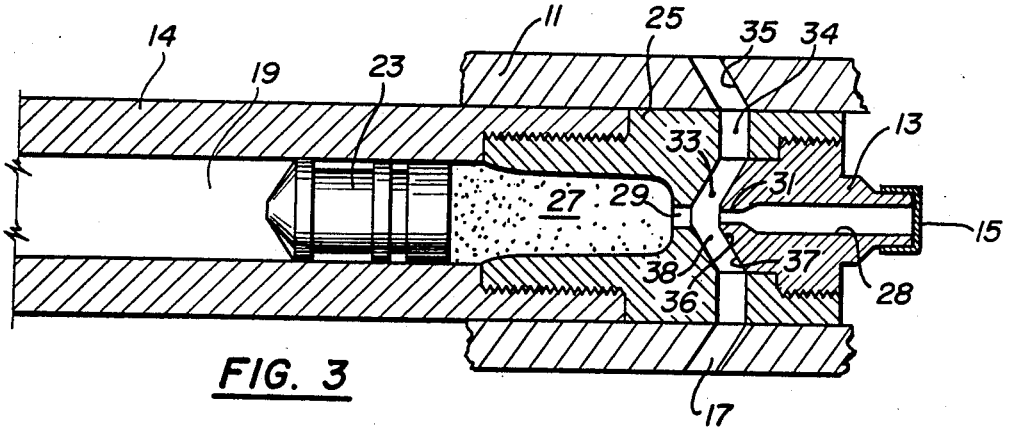
FIG. 3 is a horizontal sectional view of the firearm taken on the line III—III of FIG. 1, showing the firearm in loaded condition.
Figure 4:
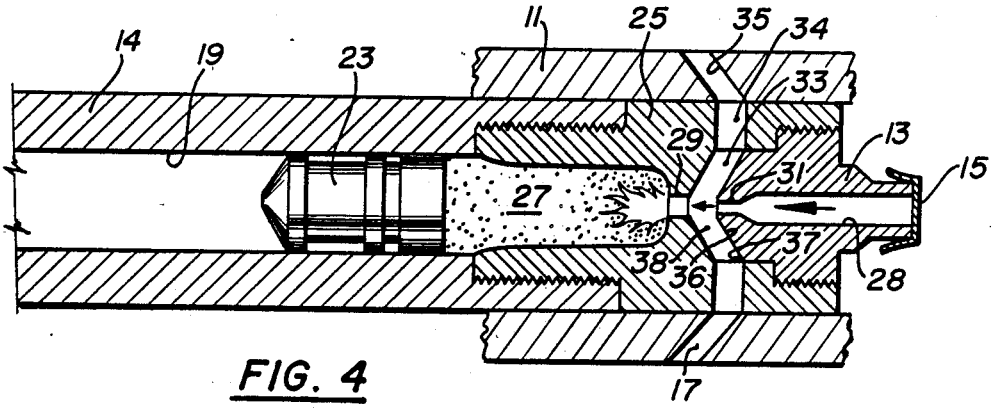
FIG. 4 is a horizontal sectional view of the firearm, showing it at the moment of ignition.
Figure 5:
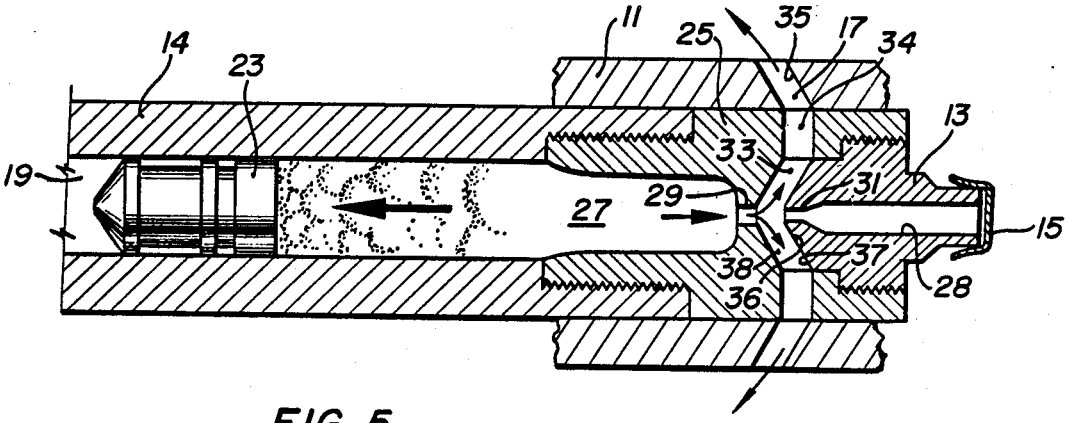
FIG. 5 is a horizontal sectional view of the firearm, showing it during powder burn.

Referring next to FIGS. 3, 4, and 5, it can be seen that the barrel 14 is mounted in the receiver 11 and has, located at its rear end, a chamber element 25 and a nipple 13. The barrel has a bore 19, while the chamber element has a cylindrical chamber 27 facing down the barrel coaxially of the bore. The nipple 13 has a primer bore 28 that is coaxial of the bore and the chamber. The venting passage 17 extends through the chamber element 25 and the receiver 11 to the exterior of the receiver, as is evident in FIGS. 1 and 2.

A small bore 29 extends axially from the chamber 27 into the venting passage and a small bore 31 extends from the primer bore 28 into the venting passage. The cross-sectional area of the venting passage is substantially greater than that of either of the said small bores. The venting passage 17 consists of two branches, each of which consists of a first, second, and third section. The first section 33 leaves the axis of the barrel and extends angularly and rearwardly. The second section 34 extends at a right angle to the axis. The third section 35 extends through the wall of the receiver angularly and forwardly to the exterior surface.

The first sections 33 of the branches of the venting passage are defined by a rearwardly-facing conical recess 36 having a channel 38 and by a conical projection 37 formed on the nipple 13. The projection 37 fits snugly in the conical recess 36.

The operation and advantages of the invention will now be readily understood in view of the above discussion. The charge of black-powder is introduced into the chamber 27 in the usual way and followed by the projectile 23. The percussion cap 15 is placed on the nipple 13. The firearm 10 is then ready to fire, as shown in FIG. 3.

When the trigger 16 is pulled, the hammer 24 falls on the cap 15 and the ignition flame passes forwardly through the primer bore 28, through the small bore 31, across the venting passage 17, and through the small bore 29 into the chamber, whereupon the charge is ignited, as shown in FIG. 4.

As the powder burns, the gas pressure forces the projectile 23 along the bore 19. At the same time, a certain amount of backfire gas is forced through the small bore 29 into the passage 17. The gas is divided into two parts, each of which flows down one of the two branches of the venting passage 17. The gas emerging from the small bore 29 strikes the conical protuberance 37 of the nipple and flows into the first section 33 of the passage 17. The gas passes through the second section 34 and through the third section 35 to the exterior. While in the first section, the gas flow has a rearward component of direction; in the second section it flows directly laterally of the axis; and in the third section it has a foreward component of direction. Very little gas flow enters the small bore 31 and passes rearwardly, since the cross-sectional area of the combined branches of the venting passage 17 is so much greater than that of the small bore.

The invention having been thus described, what is claimed as new and desired to secure by Letters Patent is:

1. A firearm, comprising:

(a) a receiver, (b) a barrel mounted in the receiver and having a bore to receive a projectile, (c) a chamber element mounted on the rear end of the barrel and having a generally cylindrical chamber facing down the barrel coaxially of the bore, and (d) a nipple mounted at the rear end of the chamber element and having a primer bore which is coaxial of the bore and the chamber, wherein a venting passage extends through the chamber element and the receiver to the exterior from the axis of the bore to both exterior sides of the receiver.

2. A firearm as recited in claim 1, wherein a small bore extends from the chamber into the venting passage and a small bore extends from the primer bore into the venting passage, the cross-sectional area of the venting passage being substantially greater than that of either of the said small bores.

3. A firearm as recited in claim 2, wherein the venting passage consists of two branches, each branch having a first section leaving the axis and extending angularly and rearwardly, a second section extending at a right angle to the axis, and a third section extending through the receiver angularly and forwardly to the exterior.

4. A firearm as recited in claim 3, wherein the chamber element is provided with a coaxial conical recess facing rearwardly and the nipple is formed with a coaxial conical protuberance that fits snugly in the said conical recess, the chamber element having a channel opening onto the surface of the conical recess, which channel and protuberance define the said first sections of the branches of the venting passage.

* * * * *